US007296404B2

(12) United States Patent
Pfaff

(10) Patent No.: US 7,296,404 B2
(45) Date of Patent: Nov. 20, 2007

(54) APPARATUS FOR CONTROLLING DECELERATION OF HYDRAULICALLY POWERED EQUIPMENT

(75) Inventor: Joseph L. Pfaff, Wauwatosa, WI (US)

(73) Assignee: HUSCO International Inc., Waukesha, WI (US)

( * ) Notice: Subject to any disclaimer, the term of this patent is extended or adjusted under 35 U.S.C. 154(b) by 137 days.

(21) Appl. No.: 11/299,926

(22) Filed: Dec. 12, 2005

(65) Prior Publication Data

US 2007/0130927 A1 Jun. 14, 2007

(51) Int. Cl.
*F16D 31/02* (2006.01)

(52) U.S. Cl. ..... 60/327; 60/469; 91/361

(58) Field of Classification Search ..... 60/327, 60/461, 469; 91/361
See application file for complete search history.

(56) References Cited

U.S. PATENT DOCUMENTS

| | | | | |
|---|---|---|---|---|
| 4,757,685 A | | 7/1988 | Burckhartzmeyer | |
| 5,025,626 A | | 6/1991 | Crosser et al. | |
| 5,510,987 A | | 4/1996 | Song | |
| 5,832,730 A | * | 11/1998 | Mizui | 60/469 |
| 6,705,079 B1 | | 3/2004 | Tabor et al. | |
| 6,880,332 B2 | | 4/2005 | Pfaff et al. | |
| 6,883,532 B2 | * | 4/2005 | Rau | 91/361 |
| 2006/0272325 A1 | * | 12/2006 | Moon | 60/426 |
| 2007/0130933 A1 | * | 6/2007 | Yoshino | 60/469 |

FOREIGN PATENT DOCUMENTS

| | | |
|---|---|---|
| DE | 10163066 A1 | 7/2003 |
| EP | 1174384 A1 | 1/2002 |
| JP | 9041428 A | 2/1997 |

* cited by examiner

*Primary Examiner*—Michael Leslie
(74) *Attorney, Agent, or Firm*—Quarles & Brady; George E. Haas

(57) ABSTRACT

A machine member driven by a hydraulic actuator may oscillate, or wag, when the hydraulic actuator decelerates or stops. The degree of oscillation is a function of the machine member's ability to track a deceleration command, which ability varies with changes in the position of the machine member and the load force acting thereon. To reduce the oscillation, a command that controls operation of the hydraulic actuator is filtered using a filter function that changes with the machine member's load. The load force exerted on the hydraulic actuator which in turn can be designated by fluid pressure that results from the hydraulic actuator. Preferably, the frequency of the filter function is varied inversely with the magnitude of the actuator load force.

21 Claims, 3 Drawing Sheets

APPARATUS FOR CONTROLLING DECELERATION OF HYDRAULICALLY POWERED EQUIPMENT

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to hydraulically powered equipment, such as off-road construction and agricultural vehicles, and more particularly to apparatus for reducing oscillation or wag when a hydraulically driven member on the equipment is decelerating, stopping, or reversing direction.

2. Description of the Related Art

With reference to FIG. 1, a backhoe 2 is a common type of earth moving equipment that has a boom assembly 3 comprising a bucket 4 attached to the end of an arm 5 which in turn is coupled by a boom 6 to the frame of a tractor 7. Three hydraulic cylinders 11 form actuators that are operated independently to move the bucket, arm, and boom. A pivot joint 8 allows the boom assembly 3 to swing left and right with respect to the rear end of the tractor 7. A hydraulic boom swing cylinder 9 is attached to the boom 6 on one side of the tractor 8 and provides the driving force that swings the boom assembly. On larger backhoes, a pair of hydraulic cylinders are attached on opposite sides of the tractor 7 to swing the boom. Hydraulic fluid is supplied to the boom swing cylinder 9 through valves that are controlled by the backhoe operator.

As the boom swings in one direction, pressurized fluid is introduced into one chamber of the boom swing cylinder 9, designated as the "driving chamber", and fluid is exhausted from the other cylinder chamber, referred to as the "exhausting chamber". When the boom swings in the opposite direction, the designation of the driving and exhausting chambers is reversed. When the operator suddenly stops the boom swing, inertia causes the motion of the backhoe boom assembly 3 to continue in the previously commanded direction. The amount of inertia is a function of the mass and extension position of the boom assembly 3 and the mass of any material carried in the bucket 4. This continued movement due to inertia compresses the hydraulic fluid in the previous exhausting chamber of the boom swing cylinder 9 and may produce cavitation in the previous driving cylinder chamber. Anti-cavitation valves typically are provided in the hydraulic system to overcome this latter problem.

Because the control valves for the cylinder are now closed, pressure in the previous exhausting chamber eventually increases to a magnitude that causes the boom assembly 3 motion to stop and recoil by moving in the opposite swing direction. This subsequent movement produces a reversal of the pressure conditions, wherein the previous driving chamber of the boom swing cylinder 9 becomes pressurized. When the boom motion in the opposite swing direction creates a sufficiently high pressure in the previous driving chamber, another reversal of the swing motion occurs. As a result, the boom assembly swing oscillates until inherent dampening provided by other forces ultimately brings the assembly to a stop. This phenomenon is known as "bounce" or "wag" and increases the time required to properly position the boom 6, thereby adversely affecting equipment productivity. The wag also is disconcerting to the machine operator. A similar motion phenomenon occurs when other types of hydraulically driven members stop.

In essence, the wag is a manifestation of the inability of the boom velocity to promptly respond to, or track, changes in the position of the valve that controls the flow of fluid to the swing cylinder. In other words, the valve closes when motion of the boom is to terminate, however the load force acting on the boom does not allow the velocity of the boom to decrease fast enough.

Various approaches have been utilized to minimize this wag. For example, U.S. Pat. No. 4,757,685 employs a separate relief valve for each hydraulic conduit connected to the swing cylinder chambers to vent fluid to a tank line when excessive pressure occurs in the associated chamber. Additional fluid is supplied from the supply line through makeup valves to counteract cavitation in the cylinder as the swing stops.

U.S. Pat. No. 5,025,626 describes a cushioned swing circuit which also has relief and make-up valves connected to the hydraulic lines for the boom swing cylinder. This circuit also incorporates a cushion valve which in an open position provides a fluid path between the cylinder hydraulic lines. That path includes a flow restriction orifice. The cushion valve is resiliently biased into the shut position by a spring and a mechanism opens the cushion valve for a predetermined time period when the pressure differential between the cylinder chambers exceeds a given threshold. Both of these previous solution attempts required additional valves and other components.

U.S. Pat. No. 6,705,079 describes another solution to the swing wag problem in which a sensor detects pressure in the hydraulic actuator. This pressure signal from the sensor is employed to determine the rate at which the pressure in the hydraulic actuator changes. When the rate of change of the pressure is less than a defined threshold after receiving a stop command, pressure in the hydraulic actuator is relieved, such as by opening a control valve connected to the hydraulic actuator.

However, there still is a desire to improve the responsiveness of the boom velocity to changes in the position of the valve and the resultant flow of fluid to the associated hydraulic cylinder, and in particular to provide a simplified mechanism for reducing wag.

SUMMARY OF THE INVENTION

The present method controls deceleration of a hydraulically driven machine member. Motion of a hydraulic actuator connected to the machine member is designated by a command, which may specify a desired velocity for example. A parameter value is produced that indicates the ability of the machine member motion to respond to change in fluid flow applied to the hydraulic actuator, which change results from alteration of the position of a valve controlling that flow. That ability is represented by the magnitude of a load force that is exerted on the hydraulic actuator by the machine member, and in particular is denoted by fluid pressure from the hydraulic actuator. The parameter value is used to configure a variable filter function applied to the command to produce a filtered command which is employed to control flow of fluid to the hydraulic actuator. The filter function controls the rate at which the motion command goes to zero to stop the machine member so that the command does not close the related valve faster than a rate the actuator and machine member are able to operate.

In one aspect of the control method, the amount of load force acting on the hydraulic actuator is employed to derive a filter frequency that defines the rate the motion command decreases to zero. The filter frequency varies inversely with changes in the load force. However, the filter frequency is preferably set to a predefined constant value when the magnitude of the load force is less than a first threshold. The filtering frequency may also be set to another predefined constant value when the magnitude of the load force is greater than a second threshold.

Another aspect is to utilize a digital filter, in which case configuring the filter involves determining a set of filter coefficients. In the preferred embodiment, the filter coefficients are derived in response to the selected filtering frequency.

DETAILED DESCRIPTION OF THE INVENTION

Figure 1:
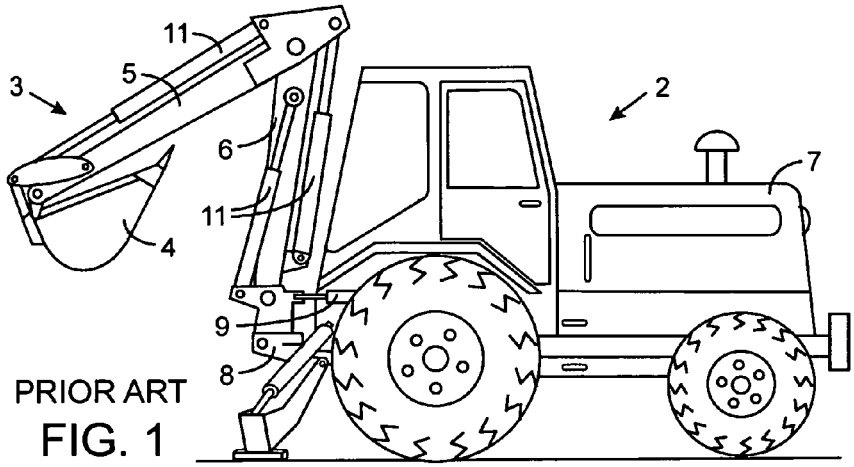
PRIOR ART FIG. 1
FIG. 1 is a side view of a backhoe incorporating the present invention.

Although the present invention is being described in the context of use on a backhoe as shown in FIG. 1, it has application on other types of machines in which large inertia machine functions are attached to the hydraulic actuator and exhibit controllability difficulties.

Figure 2:
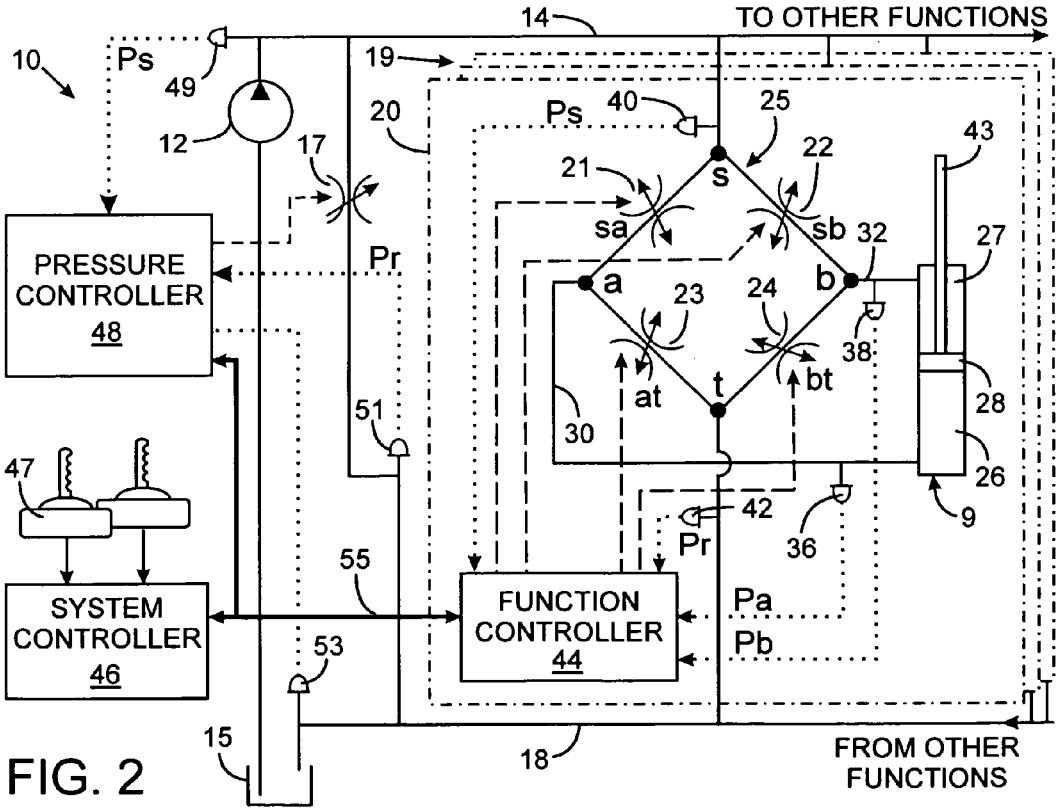
FIG. 2 is a schematic diagram of the hydraulic system for the backhoe.

With initial reference to FIG. 2, the elements of the boom assembly 3 of the backhoe 2 are moved by a novel hydraulic system 10 that includes the hydraulic actuators, such as the boom swing cylinder 9. The hydraulic system 10 has a positive displacement pump 12 that is driven by a motor or engine (not shown) to draw fluid from a tank 15 and furnish the fluid under pressure to a supply conduit 14. An unloader valve 17 (such as a proportional pressure relief valve) is connected between the supply conduit 14 and a tank return conduit 18 that leads to the system tank 15. Operation of the unloader valve 17 regulates pressure in the supply conduit 14. The novel technique for reducing wag described herein also can be implemented on a hydraulic system that employs a variable displacement pump or other types of hydraulic actuators.

The supply conduit 14 and the tank return conduit 18 are connected to a plurality of hydraulic functions 19 and 20 on the backhoe. Separate hydraulic functions are provided for swinging the boom 6, raising the boom, moving the arm 5 and pivoting the bucket 4. The hydraulic function 20 for swinging the boom is illustrated in detail and other functions 19 have similar components and operation. The hydraulic system 10 is a distributed type in that the valves for each function and control circuitry for operating those valves are located adjacent to the associated hydraulic actuator. For example, those components for controlling boom swing are located at or near the swing cylinder 9 or the pivot joint 8.

In the boom swing function 20, the supply conduit 14 is connected to node "s" of a valve assembly 25, which also has a node "t" that is connected to the tank return conduit 18. The valve assembly 25 includes a workport node "a" connected by a first hydraulic conduit 30 to the head chamber 26 of the boom swing cylinder 9, and has another workport node "b" coupled by a second conduit 32 to the rod chamber 27 of boom swing cylinder 9. Four electrohydraulic proportional (EHP) valves 21, 22, 23, and 24 control the flow of hydraulic fluid between the nodes of the valve assembly 25 and thus control fluid flow to and from the boom swing cylinder 9. The first EHP valve 21 is connected between nodes "s" and "a", and controls fluid flow between the supply conduit 14 and the head chamber 26 of the boom swing cylinder 9. The second EHP valve 22, is connected between nodes "s" and "b" and controls flow of fluid between the supply conduit 14 and the cylinder rod chamber 27. The third EHP valve 23 is connected between node "a" and node "t" and controls EHP flow between the head chamber 26 and the return conduit 18. The fourth EHP valve 24, between nodes "b" and "t", controls fluid flow between the rod chamber 27 and the return conduit 18.

The hydraulic components for the boom swing function 20 also include two pressure sensors 36 and 38 which detect the pressures Pa and Pb within the head and rod chambers 26 and 27, respectively, of boom swing cylinder 9. Another pressure sensor 40 measures the pump supply pressure Ps at node "s", while pressure sensor 42 detects the return conduit pressure Pr at node "t". Pressure sensors 40 and 42 may not be present on all the hydraulic functions.

The pressure sensors 36, 38, 40 and 42 for the boom swing function 20 provide input signals to a function controller 44 which produces signals that operate the four electrohydraulic proportional valves 21-24. The function controller 44 is a microcomputer based circuit which receives other input signals from a computerized system controller 46, as will be described. A software program executed by the function controller 44 responds to those input signals by producing output signals that selectively open the four electrohydraulic proportional valves 21-24 by desired amounts to properly operate the boom swing cylinder 9.

The system controller 46 supervises the overall operation of the hydraulic system by receiving operator input signals from joysticks 47 and exchanging signals with the function controllers 44 and a pressure controller 48. The signals are exchanged among those controllers over a communication network 55 using a conventional message protocol. This enables the control functions for the hydraulic system 10 to be distributed among the different controllers 44, 46 and 48.

Figure 3:
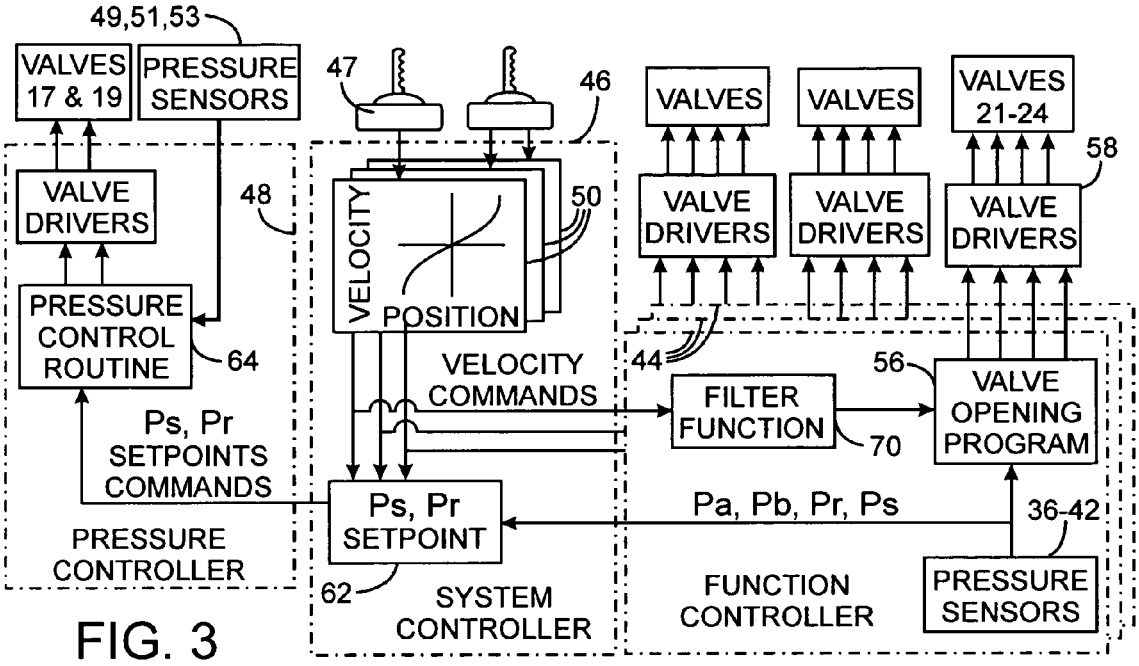
FIG. 3 is a control diagram for the hydraulic system.

With reference to FIG. 3 and the boom swing function 20, the machine operator manipulates a joystick 47 to indicate desired swing motion for the boom assembly 3. The output signal from the joystick 47 is applied to an input of a mapping routine 50 in the system controller 46, which converts the signal indicating the joystick position into a signal denoting a desired velocity for the hydraulic actuator being controlled. The mapping function can be linear or have other shapes as desired. The mapping routine may be implemented by an arithmetic expression that is solved by the computer within system controller 46, or the mapping may be accomplished by a look up table stored in the system controller's memory. The output of the mapping routine 50 is a velocity command indicating the direction and speed at which the swing cylinder 9 is desired to move the boom assembly.

The velocity commands for the swing cylinder 9 and the other hydraulic actuators 11 are sent to a setpoint routine 62 that determines the desired pressures for the supply and return conduits 14 and 18. Specifically, the setpoint routine 62 ascertains a supply pressure required by each hydraulic function 19 and 20 and selects the greatest of those pressures as the supply conduit pressure setpoint Ps. The setpoint routine 62 also determines a return conduit pressure setpoint Pr in a similar manner. These pressure setpoints Ps and Pr are applied as inputs to the pressure controller 48 that also receives signals from a supply conduit pressure sensor 49 at the outlet of the pump, a return conduit pressure sensor 51, and a tank pressure sensor 53. The pressure controller 48 responds to those inputs by operating the unloader valve 17 to regulate supply conduit pressure and the tank control valve 16 to control the return conduit pressure to achieve the desires setpoint pressures.

The velocity command for the swing cylinder 9 also is sent from the mapping routine 50 to the associated function controller 44 where it is applied to a valve opening program 56 comprises software that determines how to operate the EHP valves 21-24 in assembly 25 to achieve the commanded velocity of the piston rod 43. The swing direction designated by the velocity command denotes which two of the valves EHP valves 21-24 are activated and an amount that those valves are to open to convey fluid to and from the swing cylinder 9. Specifically valves 21 and 24 are opened to extend the piston rod 43 from the swing cylinder, and valves 22 and 22 are opened to retract the piston rod.

The magnitude of the velocity command and the measured pressures (Pa, Pb, Pr, Ps) are utilized by the valve opening routine to determine the amount that each of the selected valves is to be opened to convey the amount of fluid flow necessary achieve the desired velocity of the piston 28. U.S. Pat. No. 6,775,974 describes one embodiment of the valve opening program 56. The resultant signals, indicating the amount that the EHP valves 21-24 are to open, are supplied to a set of valve drivers 58 which apply the appropriate magnitude of electric current to operate each of the two selected valves.

The valve opening program 56 includes a software routine that mitigates wag of the boom assembly 3 that otherwise could occur when swing cylinder is desired to stop. With reference to FIGS. 2 and 3, assume that the backhoe operator has been swinging the boom assembly 3 in one direction. In this case, the signal from the joystick 47 for this machine operation indicates a desired velocity for the swing action. The velocity command is transmitted from the system controller 46 to the function controller 44 which controls the operation of the swing hydraulic cylinder 9. Thus, the function controller 44 is producing signals that open either the first and fourth EHP valves 21 and 24 or the second and third EHP valves 22 and 23, depending upon the direction of the swing.

When the backhoe operator desires to stop the boom swing, the joystick 47 is released and allowed to return to its center, neutral position. In this position, the mapping routine 50 produces a zero velocity command which is transmitted to the function controller 44 for the swing operation. If the function controller 44 simply responded to the zero velocity command by immediately shutting the valves, a swing wag could occur, especially if the boom assembly 3 had a relatively large inertia. That function controller 44, however, is programmed to reduce swing wag by low pass filtering the velocity command and thereby control the rate at which the EHP valves close in response to the velocity command. A dynamically varying filter function is utilized so that the swing decelerates in a controlled fashion under both relatively small and very large loads. Preferably a digital second order filter function is used.

In order that the filtering performs satisfactorily over a wide range of load force, the filter is disabled if the increasing pressure in the cylinder chamber, which tends to brake the swing motion, exceeds a predefined threshold level. When this happens the frequency of the low pass filter is decreased to almost a frozen state which has the effect of maintaining the EHP valves 21-24 in the existing open position. The filter and thus the EHP valves stay in the "frozen state" until the breaking cylinder chamber pressure falls below the predefined threshold level, at which time the filter is re-enabled and continues to decay to zero. By disabling the filter while the hydraulic function is going over a relief pressure setting for the hydraulic cylinder, the position of the EHP valves are closely coupled to the speed of the piston 28. In other words, the valves only close at a rate the machine system will support. A major advantage is that this solution to the swing wag problem does not require any additional components for the hydraulic system 10 and merely involves programming the function controller with the appropriate software routine.

Figure 4:
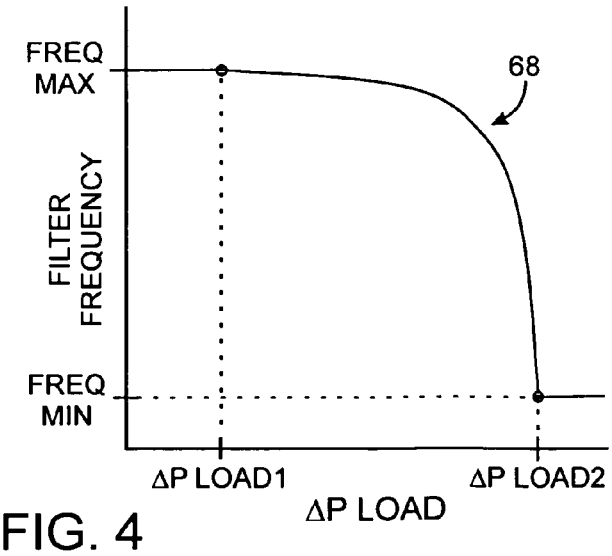
FIG. 4 graphically depicts a filter function that is applied to a backhoe boom swing command to prevent the boom wag upon stopping.

FIG. 4 graphically depicts the filter function 68 in terms of a relationship between the filter frequency and a load pressure differential (ΔP LOAD) between the two chambers 26 and 27 of the swing cylinder 9. Those cylinder chamber pressures are measured by sensors 36 and 38 in FIG. 2. This pressure differential corresponds to the load force that the boom assembly 3 exerts on the swing cylinder 9, which in turn corresponds to the responsiveness of the boom motion to variations in the fluid flow applied to a hydraulic actuator due to changes in the position of the respective control valve. As will be described, the filter frequency is varied as a function of changes in the load pressure differential as defined by the function for the filter depicted in FIG. 4. However, it should be understood that the illustrated filter function merely is exemplary and other functions and breakpoints can be utilized without departing from the concept of the present invention. In that regard, the upper and lower limits of the filter frequency have been selected as 1.1 Hz and 0.05 Hz, respectively. Applying these frequency boundaries to the filter function, defines two pressure differential thresholds. The first is a lower pressure threshold, ΔP LOAD1, below which the filter frequency remains constant at the maximum filter frequency (FREQ MAX). The second pressure threshold, designated ΔP LOAD2, is an upper threshold limit above which the filter frequency remains constant at a minimum frequency (FREQ MIN). For values of the load pressure differential between the first and second thresholds, the filter frequency varies as designated by the curved line in the graph.

Figure 5:
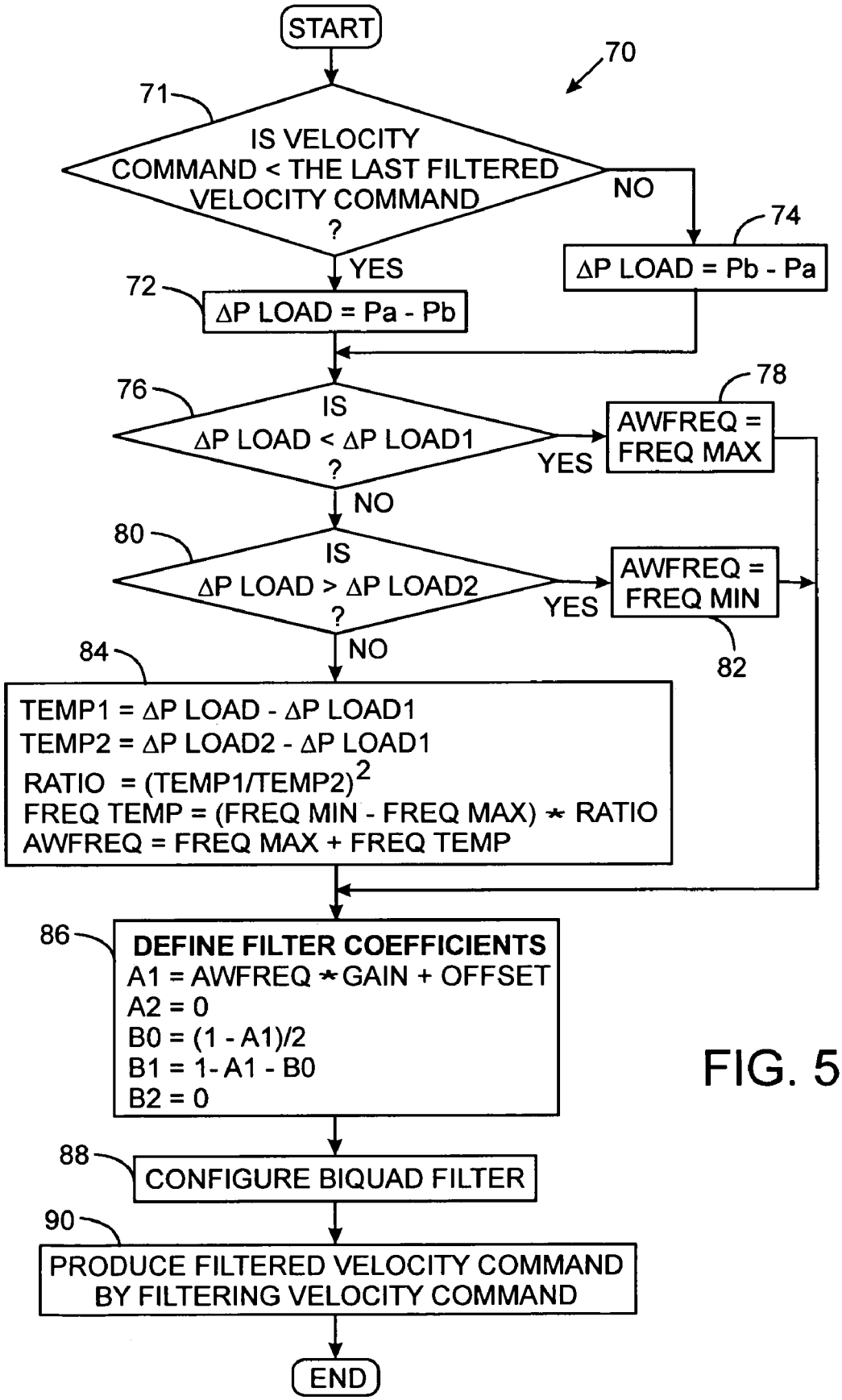
FIG. 5 is a flowchart of a software routine that implements the filter function.

With reference to FIG. 5, upon the receipt of a velocity command, the function controller 44 applies an anti-wag filter routine 70 to that command. It should be understood that swing of the boom assembly 3 in one direction is arbitrarily defined as having a positive velocity, whereas swing movement in the opposite direction is designated as a negative velocity. Knowing the direction of the swing is necessary in order to determine a cylinder pressure differential value which has the proper arithmetic sign for use in subsequent calculations by the filter function. The filter routine 70 commences at step 71 where the direction of the present swing is ascertained by determining whether the velocity command is less than the prior filtered velocity command produced by the filter routine 70. If that relationship is true, the program execution branches to step 72 at which the value of the measured pressure Pb within the rod chamber 27 of the swing cylinder is subtracted from the measured pressure Pa within the head chamber 26 to produce a differential pressure value, ΔP LOAD. Otherwise, if the expression within step 71 is false, the program execution branches to step 74 at which the measured head chamber pressure Pa is subtracted from the rod chamber pressure Pb to produce the differential pressure value, ΔP LOAD.

Then at step 76 a determination is made whether the newly calculated value for ΔP LOAD is less than the first, or lower, threshold ΔP LOAD1 (see FIG. 4). If that is the case, the program execution branches to step 78 at which a value for the anti-wag filter frequency (AWFREQ) is set to the maximum frequency value (FREQ MAX), which for example is 1.1 Hz. The program execution then jumps to step 86. However, if the value of ΔP LOAD is not less than the first threshold, the program execution advances to step 80 at which a determination is made whether that value is greater than the second, or upper, threshold ΔP LOAD2. In this latter case, the program execution branches to step 82 at which the anti-wag filter frequency (AWFREQ) is set to the minimum frequency value (FREQ MIN), which for example is 0.05 Hz. Thereafter the program execution jumps to step 86.

However, if neither expression at step 76 or 80 is true, meaning that the value of ΔP LOAD is between the two pressure differential thresholds inclusively, the program execution advances to step 84 to calculate a value for the filter frequency. That frequency is produced by solving a series of equations, the first of which produces a value designated TEMP1 which is equal to the value of ΔP LOAD minus the first threshold value ΔP LOAD1. Another value designated TEMP2 equals the difference between the two pressure differential thresholds and is derived by subtracting the first threshold ΔP LOAD1 from the second threshold ΔP LOAD2. Next a ratio is calculated by dividing TEMP2 into TEMP1 and squaring the result. A temporary frequency value, (FREQ TEMP) is produced by first subtracting the maximum frequency value (FREQ MAX) from the minimum frequency value (FREQ MIN) which produces a negative value that then is multiplied by the previously calculated ratio. The anti-wag frequency (AWFREQ) is produced at the final calculation step by summing the maximum frequency (FREQ MAX) with the negative value of the variable FREQ TEMP. The program execution then advances to step 86. As the hydraulic actuator (e.g. swing cylinder 9) slows, the pressure differential ΔP LOAD changes and step 84 dynamically changes the anti-wag frequency (AWFREQ) in a corresponding manner until the boom assembly 3 stops.

Upon entering step 86 of the filter function 68, the newly derived value for the anti-wag frequency (AWFREQ) is used to determine the coefficients for the filter function. Preferably, a biquadratic digital filter is employed to filter the velocity command. The filter function for a biquadratic filter is given by the expression:

$$y(n) = \frac{B0 * x(n) + B1 * x(n-1) + B2 * x(n-2)}{A1 * y(n-1) + A2 * y(n-2)} \quad (1)$$

where y(n) is the filter function output referred to as a filtered velocity command, terms A1, A2, B0, B1 and B2 are filter coefficients, x(n) is the present value of the velocity command, x(n−1) and x(n−2) are the previous two values of the velocity command, and y(n−1) and y(n−2) are the previous two values of the output of the filter.

The filter coefficients are defined according to the equations provided at that step 86 in FIG. 5. Specifically the value for coefficient A0 is produced by multiplying the anti-wag frequency (AWFREQ) by a gain factor and adding an offset. However, it will be understood by those skilled in the art, that not only can the filter coefficients for a biquadratic filter be defined in a other manners, other types of filters and filter functions may be utilized to reduce the effects of swing wag. Next the defined filter coefficients are passed to the conventional digital biquadratic filter at step 88 to configure that filter. Then at step 90, the filter function is applied to the present velocity command to produce the filtered velocity command, which is utilized by the valve opening program 56 in FIG. 2 to produce the signals for operating the four electrohydraulic valves 21-24.

Thus, the filter routine varies the filter frequency depending upon the load force that the backhoe boom assembly 3 exerts on the hydraulic actuator, i.e. the swing cylinder 9 and piston 28. This frequency variation conforms to the filter function graphically depicted in FIG. 4, such that the greater the load force, the lower the filter frequency and hence, the slower the response of the valve assembly 25 to changes of the velocity command. By adapting, the filter function to the magnitude of the load force acting on the swing cylinder 9, the command filtering is optimized. Under relatively small load force conditions, which produce a commensurate low amount of inertia, a relatively high filter frequency is employed. As the load force and resultant inertia increases, the filter frequency decreases to adequately control the valve assembly 25 to decelerate the boom sufficiently fast to avoid the wag.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A method for controlling motion of a machine member that is driven by fluid applied to a hydraulic actuator connected to the machine member, the method comprising:

producing a command that designates desired motion of the machine member;

producing a parameter value that denotes responsiveness of the motion of the machine member to changes in flow of the fluid applied to the hydraulic actuator;

configuring a filter function that varies in response to the parameter value;

applying the filter function to the command to produce a filtered command; and controlling the flow of fluid to the hydraulic actuator in response to the filtered command.

2. The method as recited in claim 1 wherein the parameter value corresponds to magnitude of a load force that acts on the hydraulic actuator.

3. The method as recited in claim 1 wherein producing a parameter value comprises sensing fluid pressure resulting from the machine member acting on hydraulic actuator.

4. The method as recited in claim 1 wherein the hydraulic actuator comprises a cylinder having two chambers; and the parameter value is a function of a difference in pressures in the two chambers.

5. The method as recited in claim 1 wherein configuring a filter function comprises utilizing a constant filter function when the parameter value is less than a threshold level.

6. The method as recited in claim 1 wherein configuring a filter function comprises utilizing a constant filter function when the parameter value is greater than a threshold level.

7. The method as recited in claim 1 wherein configuring a filter function comprises deriving a filtering frequency which varies in response to the parameter value.

8. The method as recited in claim 7 wherein the filtering frequency varies inversely with change in a magnitude of the parameter value.

9. The method as recited in claim 1 wherein applying the filter function employs a biquadratic filter function.

10. The method as recited in claim 1 wherein applying the filter function controls a rate at which the flow of fluid to the hydraulic actuator changes in response to the command.

11. The method as recited in claim 1 wherein controlling flow of fluid to the hydraulic actuator comprises operating a hydraulic valve assembly.

12. A method for controlling deceleration of a machine member that is driven by a hydraulic actuator, the method comprising:

producing a velocity command that designates a desired velocity for the hydraulic actuator;

determining magnitude of a load force that acts on the hydraulic actuator;

configuring a filter in response to the magnitude of the load force;

filtering the velocity command to produce a filtered command; and controlling flow of fluid to the hydraulic actuator in response to the filtered command.

13. The method as recited in claim 12 wherein determining the magnitude of the load force comprises sensing fluid pressure that results from the load force acting on hydraulic actuator.

14. The method as recited in claim 12 wherein the hydraulic actuator comprises a cylinder having two chambers; and determining the magnitude of the load force comprises determining a difference in pressures in the two chambers.

15. The method as recited in claim 12 wherein configuring a filter comprises deriving a filtering frequency which varies in response to the magnitude of the load force.

16. The method as recited in claim 15 wherein deriving a filtering frequency comprises setting the filtering frequency to a predefined constant value when the magnitude of the load force is less than a threshold.

17. The method as recited in claim 15 wherein deriving a filtering frequency comprises setting the filtering frequency to a predefined constant value when the magnitude of the load force is greater than a threshold.

18. The method as recited in claim 15 wherein configuring the filter further comprises defining a set of filter coefficients in response to the filtering frequency.

19. The method as recited in claim 12 wherein the filter comprises a digital filter; and configuring the filter comprises defining a set of filter coefficients in response to the magnitude of the load force.

20. The method as recited in claim 12 wherein filtering the velocity command employs a biquadratic filter.

21. The method as recited in claim 12 wherein filtering the velocity command controls a rate at which the flow of fluid to the hydraulic actuator changes in response to the velocity command.

* * * * *